United States Patent [19]

Kurz

[11] Patent Number: 4,601,082

[45] Date of Patent: Jul. 22, 1986

[54] VACUUM CLEANER

[76] Inventor: Gerhard Kurz, Industriestrasse, 7262 Althengstett, Fed. Rep. of Germany

[21] Appl. No.: 655,579

[22] Filed: Sep. 28, 1984

[30] Foreign Application Priority Data

Feb. 8, 1984 [DE] Fed. Rep. of Germany ..... 3404281
Aug. 24, 1984 [DE] Fed. Rep. of Germany ..... 3431164

[51] Int. Cl.[4] ..... A47L 9/28

[52] U.S. Cl. ..... 15/319; 250/574; 356/438

[58] Field of Search ..... 15/319, 339; 250/574; 356/342, 438, 439

[56] References Cited

U.S. PATENT DOCUMENTS 3,952,361 4/1976 Wilkins ..... 15/319
4,099,065 6/1978 Malinowski ..... 356/439
4,099,861 7/1978 Abel ..... 15/339 X
4,175,892 11/1979 Debrey ..... 15/339
4,297,578 10/1981 Carter ..... 356/439
4,413,911 11/1983 Rice ..... 356/438

*Primary Examiner*—Chris K. Moore
*Attorney, Agent, or Firm*—McAulay, Fields, Fisher, Goldstein & Nissen

[57] ABSTRACT

Vacuum cleaner for use in industry and household comprising a housing and an electric motor driving the blower generating the working vacuum, and optional maneuvering means for moving a suction nozzle over the material to be cleaned. There is provided in the area of the channel passed by the dust and dirt particles drawn in, an optical sensor comprising a light transmitter and a coacting light receiver so that the quantity of the dust and dirt particles drawn in at any time is detected. After comparison of the value so determined with a given threshold value, either a visual and/or an acoustic signal are obtained and/or a power variation of the electric motor driving the blower is effected.

15 Claims, 3 Drawing Figures

VACUUM CLEANER

STATE OF THE ART

The present invention relates to a vacuum cleaner. It has been known in the art to operate vacuum cleaners with varying cleaning power, depending for instance on the type and nature and/or the degree of soiling of the material to be cleaned, preferably by acting in a suitable manner, for instance manually, on a speed control associated with the electric motor driving the blower of the vacuum cleaner. Such speed-controlled vacuum cleaners are energy-saving and, being specifically adaptable to the different materials to be cleaned, operate satisfactorily in this respect. A critical point of all types of vacuum cleaners is, however, to be seen in the fact that the length of the cleaning process is determined exclusively by the operator's personal judgement and not by the degree of soiling and/or the cleaning effect achieved from the beginning of the cleaning process to any given point of time or, to say it in other words, by the degree of cleanliness of the material to be worked, although this would of course be much more desirable.

For example, a housewife will normally work the floors to be cleaned until she feels in her sole and personal judgement that a certain degree of cleanliness has been reached. However, this method is by no means appropriate to determine objectively whether or not the desired degree of cleanliness has actually been reached, if a cleaning effort of this intensity was actually required, or if an additional cleaning effort would still be necessary, for instance in the case of deep-pile carpets, so that the vacuum cleaners in question offer the drawback that on the one hand their technical perfection has been improved constantly by providing a plurality of possible switching conditions and selective power steps, yet the cleaning process performed with such vacuum cleaners has remained unchanged and the degree of cleanliness achieved is now as before substantially a matter of chance.

These considerations are by no means of subordinate importance, as some would be inclined to assume, but rather of great significance, from the technical point of view, because the improper use of a vacuum cleaner over long years, due to the operating conditions being constantly wrongly assessed by the operator, leads to disadvantages which may by far exceed the cost of the vacuum cleaner itself. If, for instance, the floors to be cleaned are normally slightly soiled only the amount of time and work expended on cleaning such floors may constantly exceed the real requirements when the cleaning effect achieved is only judged by appearance, and one will possibly also have to put up with excessive and absolutely unnecessary wear. This disadvantage may be particularly severe when working high-quality carpets with an intensity that would normally not be required to achieve proper cleaning—but on the other hand, a merely superficial cleaning effect could cause dirt, solid particles, dust and the like to penetrate deeply into the material to be cleaned and, in the long run, to deteriorate and even destroy it.

Now, it is the object of the present invention to provide a vacuum cleaner capable of informing the operator whether or not the cleaning effect achieved by the cleaning operation at a given point of time may be regarded as sufficient or if further cleaning is required because there is more dirt and/or dust to be removed, i.e. sort of a "thinking" vac.

ADVANTAGES OF THE INVENTION

The present invention achieves this object and offers the advantage that the operator of the vacuum cleaner is provided with clear and reliable, but not disturbing indication means consisting of light emitting diodes of different colors arranged at a conspicuous place, preferably in the handle area of the vacuum cleaner fittings, and informing the operator at any given point of the cleaning operation of whether there is still dust to be removed or the nozzle of the vacuum cleaner can be moved on to an area of the material to be still cleaned, it being additionally possible to use the optical receiver means, and the evaluation and switching means associated therewith, simultaneously and in a particularly advantageous manner for controlling the power of the electric motor driving the blower of the vacuum cleaner, for instance by connecting the output of the evaluation circuit to the input of a phase control used for controlling the electric motor.

If, therefore, the evaluation of the amount of dust detected by the optical sensor is effected discontinuously, for the indication means informing the operator, the power control derived from the signals of the optical sensor may well be effected continuously, in any desired manner. The following solutions are imaginable: If the amount of dust detected by the optical sensor is from normal to low and reducing gradually, the sensor may initially cause the electric motor, through the evaluation circuit associated therewith, to run up to maximum power, whereupon the amount of dust detected in this condition is measured to decide whether cleaning is to be continued in the area being worked—which may be the case when the amount of dust rises when the motor operates at maximum power—or whether after a short additional cleaning period the amount of dust drops below a lower threshold value in which case, in addition to switching over the visual indication, the power of the electric motor may be reduced again so that the electric blower motor running at different speeds will provide the operator also with an acoustic signal informing him whether or not he is to continue working the area being cleaned—which is the case when the motor is not blocked—or if the vacuum cleaner is to be moved on to another area.

A particular advantage of the present invention is to be seen in the reliability of the detection system which can be set or adjusted to ensure that any amount of dust or dirt particles is safely detected, but that, on the other hand, the indication is switched over to GOOD preferably with a pre-determinable delay when a pre-set threshold value is exceeded. The responsivity of the system permits a high degree of cleanliness of the material being worked to be achieved, if this should be desired. On the other hand, an advantageous improvement of the present invention allows the system to be set to different threshold values, depending on the requirements of the different materials and/or the user of the vacuum cleaner.

A further advantage is to be seen in the fact that at least the visual indication means informing the user of the degree of cleanliness achieved at any given time can be arranged in the area of the maneuvering means, for example the handle, by which the operator guides either the vacuum cleaner or, in the case of a wheel-mounted vacuum cleaner, the rigid tube attached to the flexible hose and carrying on its end the suction brush. Corresponding investigations have shown that after short use of such a vacuum cleaner equipped with such indication means capable of being switched over between two indication states (for example a green light emitting diode indicating that the desired degree of cleanliness has been reached, and a red light emitting diode indicating that the amount of dust and solid particles detected exceeds still a pre-determined threshold value) the operator gets sufficiently used to the luminous indication, which can be arranged with advantage in the handle where it is at any time particularly well visible, so that he will automatically move the nozzle of the vacuum cleaner on to a new area when the green GOOD indication lights up and, on the other hand, continue to clean the same spot so long as the green indicating lamp lights. The indicating means are observed quite automatically, without any conscious effort, and even under an oblique angle of vision. The constantly changing indications relating to the degree of soiling given at any time do by no means "overfeed" the user with superfluous information, but provide him on the contrary with efficient means for achieving thorough, yet quick cleaning of the materials to be worked with the vacuum cleaner, depending on the latter's rating in connection with the power control, and the amount of dust detected by the optical sensing means. There also exists the possibility to provide acoustic indication means, either exclusively or in addition to the visual indication, informing the user of the absence or presence of dust, for example through a short beep.

Other features permit advantageous developments or improvements of the vacuum cleaner of the invention. It may, for example, be advantageous to design the light transmitter and light receiver as a so-called reflex coupler arranged in a common housing and comprising a luminescent diode emitting in the short infrared range as the transmitter, and a corresponding phototransistor as the receiver. The transmitter and receiver are equally directed so that the receiver is supplied only with the light reflected by any dust or solid particles encountered, which act insofar as reflecting agents. The receiver then ensures by suitable amplification that even minor degrees of soiling are safely detected, if this should be desired, preferably by setting a corresponding threshold value.

Preferably, the reflex coupler is also arranged in the area of the handle, adjacent the point where the rigid tube carrying the suction nozzle of a wheel-mounted vacuum cleaner is attached. The effective, i.e. the transmitting and receiving surface of the reflex coupler is preferably arranged flush with the inner wall of the tube so that on the one hand no lint or dirt particles will be retained or accumulate and, on the other hand, occasional cleaning of the reflex coupler can be effected easily by a single wiping movement of the finger before the rigid tube is mounted.

A further advantageous improvement of the present invention in the area of the optical sensor is obtained when the light transmitter and the light receiver are arranged diametrically opposite each other in a suitable area of the suction channel so that the system does not depend on the reflexion properties of the dust and solid particles encountered; rather, the receiver will respond, after corresponding adaptation of the evaluation circuit, every time the direct ray path between the light transmitter and the light receiver is disturbed or interrupted. Such an arrangement makes it possible to evaluate even non-reflecting dust particles as may be encountered in certain applications, for instance in the industrial area in the form of graphite dust when processing carbon brushes, or in the form of similar materials.

DRAWING

Certain embodiments of the invention will be described hereafter in detail with reference to the drawing in which FIG. 1 shows a diagrammatic view of a vacuum cleaner comprising indicating means indicating the amount of dirt particles momentarily encountered, and sensor means for detecting the dirt particles, both means being arranged in the handle area of the vacuum cleaner;

FIG. 2 is one example of a circuit for the electric switching means reacting to the signals received from the transmitter, with associated indicating means; and FIG. 3 shows a preferred embodiment of a combined light transmitter/receiver in the form of a so-called reflex coupler.

SPECIFICATION

It is the basic idea of the present invention to detect, by suitable measuring means, the amount of dirt or dust particles encountered at any time during operation of a vacuum cleaner and to provide the operator with a corresponding message in the form of a discontinuous indication, preferably through correspondingly controlled light emitting diodes of different color (green/red) and/or to use signals derived continuously or discontinuously from the amount of dust particles encountered for controlling the power of the electric motor 4 driving the blower of the vacuum cleaner.

In FIG. 1, the body of the vacuum cleaner can be seen at 1. It comprises in this embodiment of a wheel-mounted vacuum cleaner with flexible hose extension a housing 2 enclosing a dust bag arrangement 3, the blower 5 driven by the motor 4 and in some cases also an electric or electronic speed control 6.

A connection to an external power force (mains connection) is shown at 7. The suction opening 8 of the vacuum cleaner is connected via a flexible plastic or metal connection 9, consisting usually of a corrugated hose or the like, with a rigid pipe 10 carrying on its end some type of suction brush 11 or other equipment, such as a beater-cleaner. The transition between the flexible hose 9 and the rigid tube 10 is formed in the embodiment shown by the handle 12 by which the operator holds the unit during operation of the vacuum cleaner.

The said handle may be equipped for example with a suitable operating button or switch 13 which is shortly depressed by the operator for switching over (manually) from one power step to the next. This makes it possible, for example, to produce a variation of the pneumatic pressure in a separate control hose by suitable, sensitive diaphragm means, which variation will cause the speed of the electric motor to be changed by the speed control. A visual display of the power steps active at any time can be provided for example in the form of a light strip 27 provided on the housing 2 of the vacuum cleaner.

According to one feature of the present invention there are provided on a suitable point which is passed by the dirt, dust or solid particles—hereafter collectively referred to as dust—during operation of the vacuum cleaner sensor means for detecting the quantity of dust encountered at any time and for transmitting the value detected for evaluation by visual indicating means. In the embodiment shown in the drawing, the sensor means take the form of light transmitters operating in the short infrared range and light receivers which are both arranged in the area of the handle 12. This area is preferred because when the vacuum cleaner is disassembled the rigid tube 10 is normally detached from the handle while the flexible hose connection 9 is usually left in place on the vacuum cleaner. However, it is of course also possible to arrange the sensor means for example in the area designated by the reference number 14, directly adjacent to the connection point between the hose and the housing of the vacuum cleaner. This area is particularly suited for the arrangement of the sensor means in the case of light-weight hand vacuum cleaners which have no flexible hose, an externally arranged dust bag and are held by the operator by a handle, in a manner similar to a broom, and moved in this position over the material to be cleaned.

The light receiver and light transmitter forming the sensor means are preferably designed in the form of a so-called reflex coupler, wherein (see FIG. 3) a luminescent diode 14*a* emitting light in the desired frequency range (short infrared range) and a phototransistor 14*b* serving as the receiver are arranged side by side in a common housing 14, with their active sides pointing in the same direction.

In this manner, the solid or dirt or dust particles 15 passing the sensor means, i.e. the reflex coupler, in the handle area act as reflecting agents so that the light emitted by the luminescent diode of the reflex coupler is reflected upon the receiver. It should be noted in this connection that light transmitters and light receivers arranged in a common housing, i.e. so-called reflex couplers, have been known before (semiconductor information service 7.81 "Reflex Coupler CNY 70", published by AEG-Telefunken).

Such reflex couplers are usually used for detecting movements of tapes in tape recorders, but also for monitoring rotary speeds, or the like.

It goes without saying that the optical light sensor for detecting the amount of dust encountered may also have a design in which the light transmitter and the light receiver are arranged in conventional manner opposite each other so that the optical sensor will respond to any interruption of the ray path by solid particles or dust, it being merely necessary in this case to adapt the evaluation circuit, which will be described in more detail in connection with FIG. 2, in a suitable manner because in this case the light receiver will be driven to full output when only little or no dust is encountered, while in the case of a reflex coupler arrangement it will practically receive no light at all in this case.

As a third possible alternative, a reflecting surface, for instance a mirror, may be arranged on the wall of the channel opposite the reflex coupler, in which case the conditions will be the same as in the case where the light transmitter and the light receiver are arranged opposite each other. One will therefore select that design which is best suited for the type of dust predominantly encountered.

The optical sensor designated in FIG. 1 by the reference number 17 is followed by electric switching means for controlling visual and/or acoustic indication means and/or power control means the design of which is shown in detail in FIG. 2.

It is a particularly advantageous feature of the present invention that the mostly optical indicating means, which may take the form of green and red luminescent diodes, can likewise be arranged at a suitable point in the area of the handle so that the changing indications can easily be observed by the operator during operation of the vacuum cleaner. In FIG. 1, these two visual indicating means are designated by the reference numbers 18*a* and 18*b*.

It goes without saying that because of the availability of highly integrated circuit means the electric evaluation and switching means may also be arranged in the handle adjacent to the optical sensor—although it is of course also possible to arrange them at 16 in the housing 2 of the vacuum cleaner and to provide corresponding signal and control lines within the corrugated hose. Preferably, these lines can be formed already during production of the hose, for instance by molding or another suitable process. In other types of vacuum cleaners which are wholly held and guided by one handle, the visual indication means informing the operator of the amount of dust encountered or the degree of cleanliness achieved should be arranged at a place where they can be observed easily by the operator, without the latter having to change his angle of vision. In the embodiment shown in FIG. 1, electric connections 9*a* are provided in the corrugated hose 9 for connecting the optical sensor and the evaluation circuit following the latter.

FIG. 2 shows a diagram of the electric evaluation and switching means which simultaneously supplies the necessary electric energy to the optical sensor 17, i.e. its luminescent diode 14*a*, and the phototransistor 14*b* acting as light receiver. The common housing is indicated in FIG. 2 by the line 14'. It can be seen that either the light emitted by the luminescent diode 14*a* hits upon reflecting dirt particles, dust 31 or the like and is reflected upon the phototransistor 14*b* as diffused light 32, or the direct ray path 33 is interrupted and the signals thus obtained are suitably amplified for being evaluated. There are further connected in series with the luminescent diode 14*a* a fixed resistor 19 and an adjustable resistor 20, and the phototransistor 14*b* is connected to supply voltage via a resistor 21 which takes in this case the form of an emitter resistance. By varying the value of the adjustable resistor 20, which in FIG. 2 takes the form of a trimmer, between for example three—maybe lockable—positions I, II and III, the sensitivity of the light sensor may be pre-set right at this point so that one is provided already at this point with a possibility to adapt the threshold value to the existing responsivity.

The phototransistor 14 is followed via a capacitor 22—preferably of high capacitance—by a standard operation amplifier 23 so that a highly responsive and quick analog circuit is received for evaluation.

Signals indicative of the receipt or non-receipt of light by the phototransistor are supplied via the capacitor 22 to the inverted input 23*a* of the operation amplifier 23; the non-inverted input 23*b* is biassed to the predetermined threshold value through a fixed voltage divider formed by the resistors 24*a* and 24*b*. If the resistors 24*a* and 24*b* are identical, one may for instance set the electric switching threshold to half the supply potential in which case a single supply voltage will suffice.

The operation amplifier is countercoupled via the resistors 25*a*, 25*b*, the latter being adjustable. The output of the operation amplifier 23 is connected with the trigger input 26*a* of a flip-flop element which may, for instance, consist of a so-called CMOS dual monoflop 26, of which only one half is used. The dwell time of the monoflop so formed can be set through a correspondingly rated capacitor 28 to be externally connected so that when the monoflop 26 is triggered—a condition which is encountered in the arrangement shown when light is received by the phototransistor, i.e. when certain dust quantities exceeding a pre-set threshold value are still present in the air drawn in by the vacuum cleaner, a red indication lamp lights up, while a green indication lamp is activated by the monoflop 26 when the air drawn in by the vacuum cleaner is substantially free from dust. The described conditions are reversed in the case of direct evaluation of the ray path.

In the embodiment shown in FIG. 2, the red indication lamp consists of a LED 29 emitting red light, the green indication lamp of a LED 30 emitting green light.

In a particularly advantageous improvement of the invention, the monoflop 26 and/or the circuit components controlling it are designed in such a manner that the reversal from the red, i.e. in this case the triggered condition of the monoflop 26, into the untriggered condition in which the green LED 30 lights, is effected with a delay of, for example, two seconds which makes the entire indication process more informative and less erratic (this applies when a reflex coupler unit is used).

In the embodiment shown in FIG. 2, a further evaluation block 34 is connected to the output of the block 26 for evaluating the light conditions in the receiver area and which consists preferably of a monoflop, but may also take the form of a bistable logic element so that resetting from one condition to the other in response to the detection of the presence of the other condition is rendered possible, an arrangement which may even be preferable. In this arrangement, the said further evaluation block 34 is connected via signal lines 34*a*, 34*b* to the two outputs of the circuit block 26 so that it is also supplied with the same information regarding the amount of dust detected. The block 34 performs the function of selectively controlling and monitoring the power of the electric motor 4 driving the blower 5, it being also possible to provide optional characteristic generators or digital circuit elements (micro processor) for controlling the power of the electric motor 4 at desire in accordance with the statements given above, in addition to the control provided by the amount of dust detected. While the signals supplied via the connection lines 34*a*, 34*b* serve to achieve discontinuous variations of the motor power, one may also optionally provide a signal connection line 35 for tapping signals corresponding to the amount of dust encountered a little further in the circuit arrangement, i.e. before the circuit block 26, with digital switching behavior, and obtain in this manner a continuous power control in response to the amount of dust measured.

It is especially the combination of the possibility to indicate the amount of dust encountered, with a correspondingly adapted power control which makes the vacuum cleaner a real "thinking" cleaner regarding the degree of cleanliness and the amount of work to be expended, because in addition to the power control through the block 34, which may of course also act upon the electric motor 4 via a phase control, as mentioned before, the operator is simultaneously provided with working instructions via the visual indication.

The electric evaluation and switching arrangement shown in the drawing permits the red indication lamp, which indicates that the desired degree of cleanliness has not yet been reached, to be re-triggered at any time through the monoflop 26 with its longer delay time, while the absence of dust or dirt particles in a quantity sufficient to provoke switching of the operation amplifier 23 will cause the monoflop 26 to reverse its position and the GOOD indication to show via the green LED 30.

It need not be feared that the area of the light sensor, for example in the handle 12, could be clogged by dirt particles or dust drawn in because an advantageous embodiment provides that the surface(s) of the optical sensor end flush with the inner wall of the handle and that in addition suitable transparent covers may be provided. As the tube 10 can easily be detached at any time from the handle, the surfaces of the optical sensor facing the suction channel can also be cleaned occasionally by simply wiping over them with a finger or with a suitable cleaning agent.

The responsivity can be pre-set for example in the form of threshold values by determining the diode current through the variable resistor 20, or else through a suitable amplification adjustment in the feedback area of the resistor 25*b*.

All the features described and shown in the specification, the following claims and the drawing may be essential to the invention either individually or in any desired combination.

I claim:

1. A vacuum cleaner for use in industry and household comprising a housing and an electric motor driving a blower that generates the working vacuum, a suction nozzle for picking up dust and dirt, and maneuvering means connected between the suction nozzle and the housing and having a suction channel therein to permit passage of the material to be cleaned from the suction nozzle to the housing, characterized in that an optical sensor comprising a light transmitter and a light receiver is provided in the suction channel which is traversed by the solid particles, dusts, threads, and the like drawn in during the cleaning operation so that, depending on the quantity of materials drawn in, the light transmission characteristics between said transmitter and said receiver changes, indicating means for indicating the level of material traversing said suction channel, and electronic switching means connected between said sensor and said indicating means and movable from a first to a second state for energizing said indicating means when the level of material in said suction channel reaches a preselected level.

2. Vacuum cleaner according to claim 1, characterized in that the light transmitter (29) emitting light preferably in the short infrared range and taking the form of a luminescent diode, and the light receiver taking the form of a phototransistor (14*b*) are equally directed and arranged in a common housing (14), thus forming a relfex coupler, so that the indication means are controlled by evaluation of the light reflected by the solid particles or dusts.

3. Vacuum cleaner according to claim 2, in which said maneuvering means comprises a rigid tube connected to said suction nozzle, a handle at the end of said rigid tube, and a flexible hose connecting said rigid tube with said housing, characterized in that the reflex coupler (17) is so arranged in the handle (12) provided between the flexible hose (9) and the rigid tube (10) carrying on its end a suction nozzle that the common transmitter and receiver side is directed inwardly.

4. Vacuum cleaner according to claim 3, characterized in that the transmitter and receiver side of the optical sensor (17) are arranged flush with the inner wall of the handle (17).

5. Vacuum cleaner according to claim 3, characterized in that the indicator means comprise first and second indicating lamps (29, 30) lighting in different colors and being likewise arranged in the handle (12).

6. Vacuum cleaner according to claim 5, characterized in that the indicating lamps comprise light emitting diodes (LED) emitting red light when said switching means is in said first state and green light when said switching means is in said second state.

7. A vacuum cleaner according to claim 6, in which said switching means comprises a delay element having a first output connected to said red light and a delayed output connected to said green light, whereby the energization of said green light is delayed.

8. A vacuum cleaner as in claim 1, in which said indicating means comprises a visual indicator.

9. A vacuum cleaner as in claim 1, in which said indicating means comprises an acoustic indicator.

10. A vacuum cleaner as in claim 1, and motor control means connected to said switching means for changing the speed of said motor when said switching means moves to said second state.

11. A vacuum cleaner according to claim 10, in which said motor control means comprises power means responsive to the quantity of material traversing said suction channel for controlling the level of power applied to the motor.

12. A vacuum cleaner according to claim 1, characterized in that the light transmitter and the light receiver of the optical sensor are arranged opposite each other in the suction channel, and said switch means moves to said first state in response to the interruption of the direct ray path between said transmitter and said receiver caused by dust or solid particles.

13. A vacuum cleaner according to claim 1, in which said switching means comprises a time delay means for delaying operation of said switching means to the second state.

14. A vacuum cleaner according to claim 1, in which said light sensor comprises a light emitting diode and a phototransistor positioned in light-receiving relationship to said light emitting diode, and a series resistance connected with said light emitting diode to control the sensitivity of said sensor.

15. A vacuum cleaner according to claim 1, in which said switching means comprises a time-delayed monostable device which produces a dust measuring signal in response to the amount of material in the suction channel rising above a threshold level.

* * * * *

US004601082C1

(12) REEXAMINATION CERTIFICATE (4313th)

United States Patent

Kurz

(10) Number: US 4,601,082 C1

(45) Certificate Issued: Apr. 24, 2001

(54) VACUUM CLEANER

(75) Inventor: Gerhard Kurz, Althengstett (DE)

(73) Assignee: Interlava AG, Lugano (CH)

Reexamination Request:
No. 90/005,679, Mar. 16, 2000

Reexamination Certificate for:

| | |
|---|---|
| Patent No.: | **4,601,082** |
| Issued: | **Jul. 22, 1986** |
| Appl. No.: | **06/655,579** |
| Filed: | **Sep. 28, 1984** |

(30) Foreign Application Priority Data

Feb. 8, 1984 (DE) ..... 3404281
Aug. 24, 1984 (DE) ..... 3431164

(51) Int. Cl.[7] ..... A47L 9/28
(52) U.S. Cl. ..... 15/319; 250/574; 356/438
(58) Field of Search ..... 15/319, 339; 250/574; 356/342, 438, 439

(56) References Cited

U.S. PATENT DOCUMENTS 3,952,361 * 4/1976 Wilkins ..... 15/319
4,021,879 * 5/1977 Brigham ..... 15/319
4,099,065 * 7/1978 Malinowski ..... 356/439
4,099,861 * 7/1978 Abel ..... 15/339 X
4,175,892 * 11/1979 Debrey ..... 15/339
4,297,578 * 10/1981 Carter ..... 356/439
4,413,911 * 11/1983 Rice ..... 356/438
4,580,311 * 4/1986 Kurz ..... 15/319
4,680,827 * 7/1987 Hummel ..... 15/319

FOREIGN PATENT DOCUMENTS

2336758 * 7/1973 (DE) .

* cited by examiner

*Primary Examiner*—Chris K. Moore

(57) ABSTRACT

Vacuum cleaner for use in industry and household comprising a housing and an electric motor driving the blower generating the working vacuum, and optional maneuvering means for moving a suction nozzle over the material to be cleaned. There is provided in the area of the channel passed by the dust and dirt particles drawn in, an optical sensor comprising a light transmitter and a coacting light receiver so that the quantity of the dust and dirt particles drawn in at any time is detected. After comparison of the value so determined with a given threshold value, either a visual and/or an acoustic signal are obtained and/or a power variation of the electric motor driving the blower is effected.

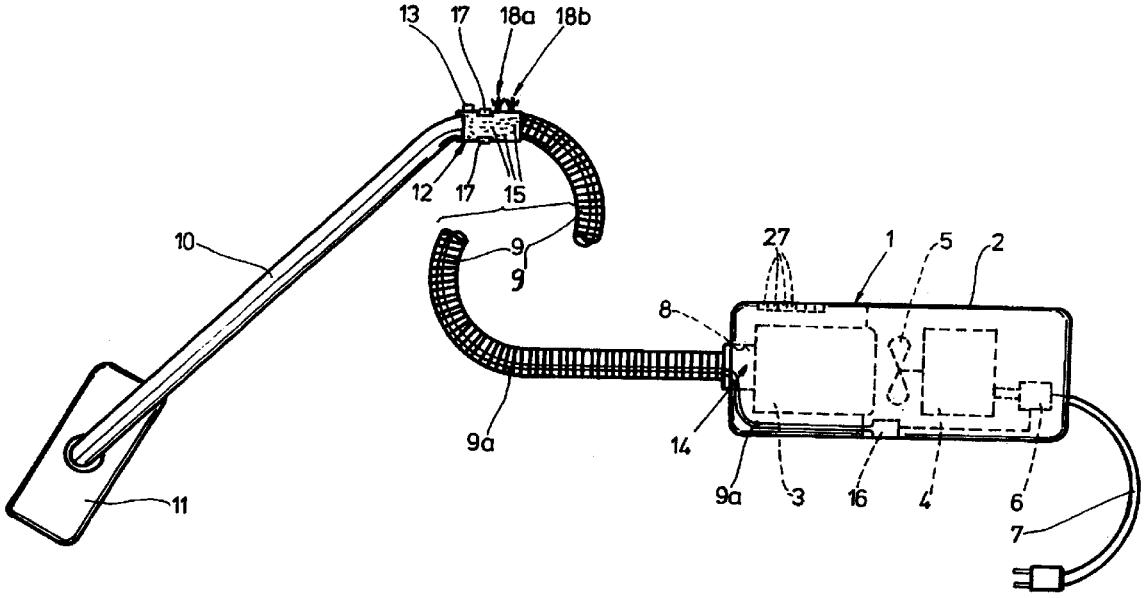

REEXAMINATION CERTIFICATE ISSUED UNDER 35 U.S.C. 307

NO AMENDMENTS HAVE BEEN MADE TO THE PATENT

Figure 1:
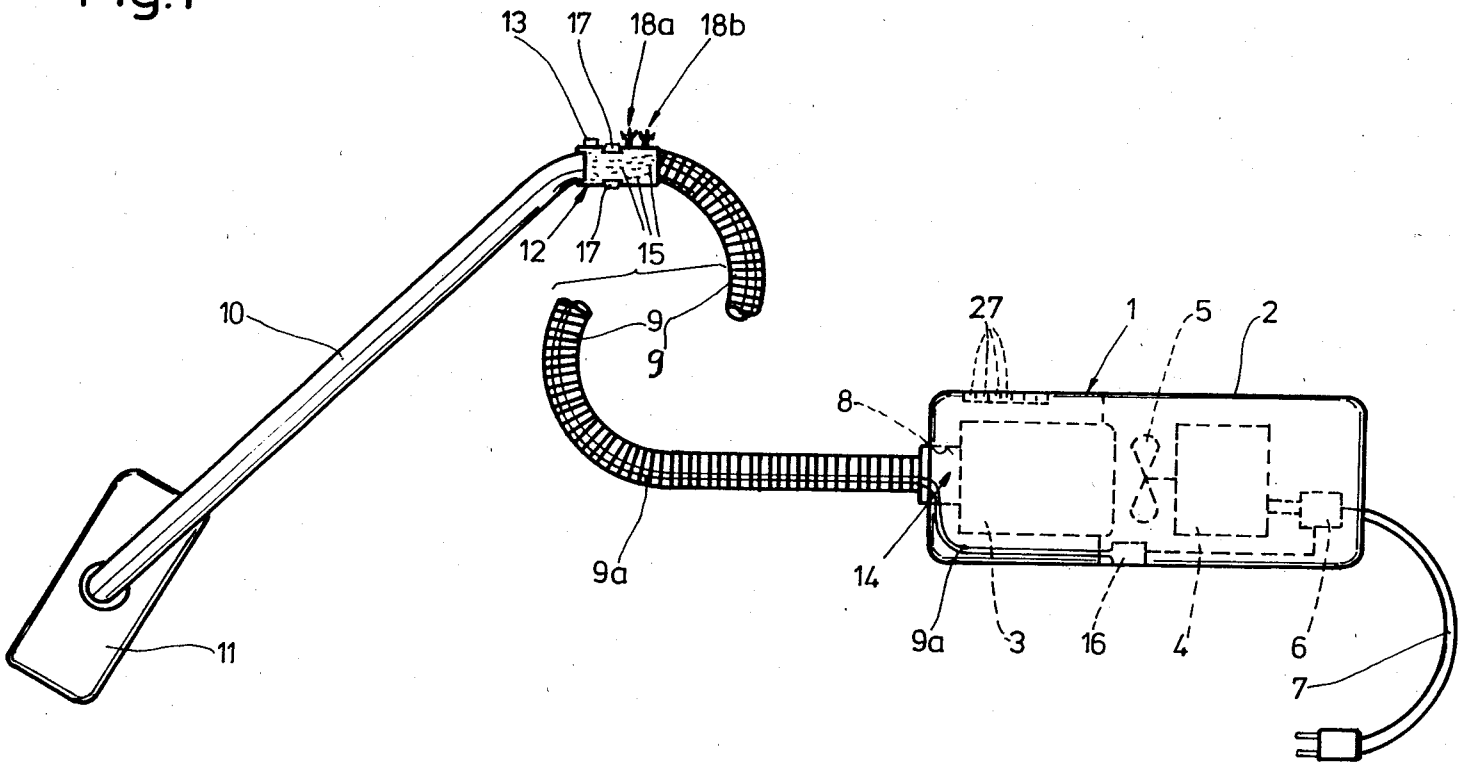
Figure 2:
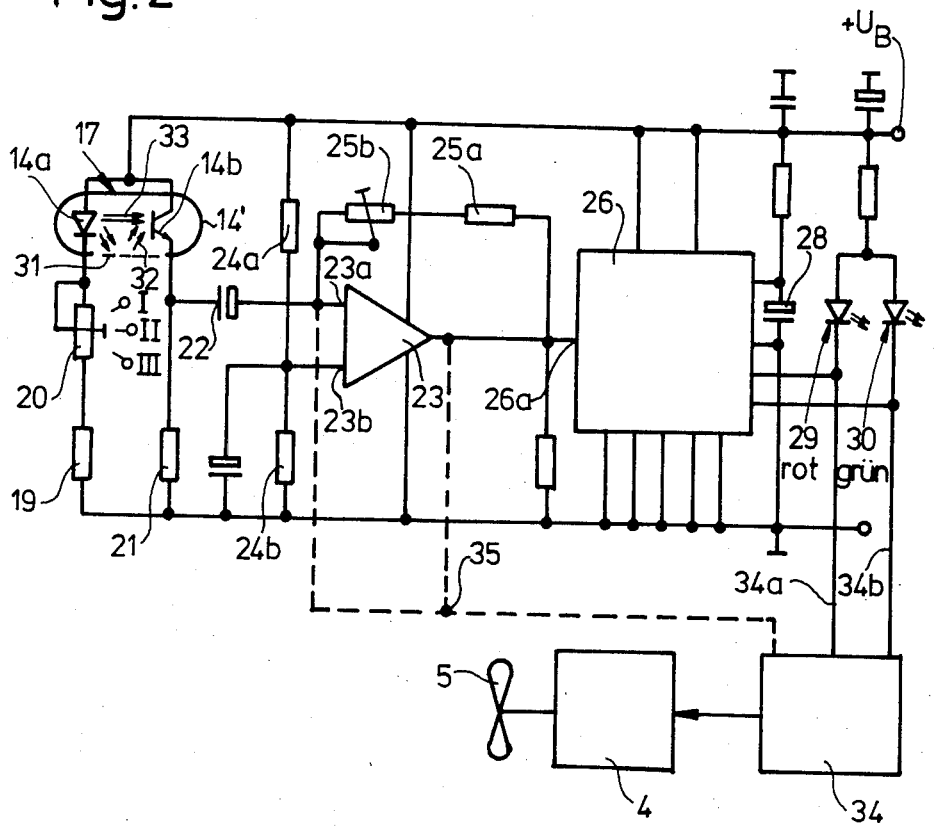
Figure 3:
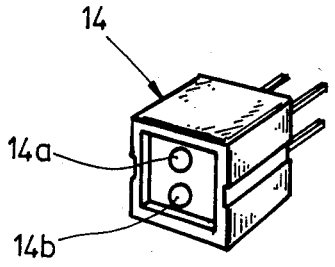

AS A RESULT OF REEXAMINATION, IT HAS BEEN DETERMINED THAT:

The patentability of claims 1–15 is confirmed.

* * * * *